US005848645A

United States Patent [19]

Jones

[11] Patent Number: 5,848,645

[45] Date of Patent: Dec. 15, 1998

[54] METHOD FOR FRACTURING AND GRAVEL-PACKING A WELL

[75] Inventor: Lloyd G. Jones, Dallas, Tex.

[73] Assignee: Mobil Oil Corporation, Fairfax, Va.

[21] Appl. No.: 697,962

[22] Filed: Sep. 5, 1996

[51] Int. Cl.[6] ..... E21B 43/267

[52] U.S. Cl. ..... 166/280; 166/308

[58] Field of Search ..... 166/280, 308, 166/278, 51

[56] References Cited

U.S. PATENT DOCUMENTS 4,945,991 8/1990 Jones .
5,082,052 1/1992 Jones et al. .
5,113,935 5/1992 Jones et al. .
5,161,613 11/1992 Jones .
5,161,618 11/1992 Jones .
5,417,284 5/1995 Jones .
5,419,394 5/1995 Jones .
5,435,391 7/1995 Jones .

*Primary Examiner*—William P. Neuder
*Attorney, Agent, or Firm*—Malcolm D. Keen

[57] ABSTRACT

A method for gravel-packing an interval within a cased wellbore wherein perforations in the well casing are cleaned of any plugging materials before placement of the gravel (e.g. sand). A screen having alternate flowpaths thereon is lowered adjacent the perforated casing and a clear fluid (e.g. clear fracturing gel) is pumped through the perforations into the formation. The gel cleans the perforation of any plugging material and fractures the formation. A gravel (e.g. sand) slurry is then pumped into the annulus and through the perforations to deposit sand in the fracture, the perforations, and the annulus around the screen. If a sand bridge(s) forms in the annulus, the alternate flowpaths will deliver the slurry to all levels within the annulus insuring good distribution of sand across the interval.

8 Claims, 1 Drawing Sheet

METHOD FOR FRACTURING AND GRAVEL-PACKING A WELL

DESCRIPTION

1. Technical Field

The present invention relates to a method for fracturing and gravel-packing a subterranean formation and in one of its aspects relates to a method for fracturing and gravel-packing a completion interval of a subterranean formation(s) wherein a gravel screen having alternate flow paths is first positioned within the wellbore adjacent the completion interval before a substantially clear fracturing liquid (i.e. a gel containing substantially no props) is injected at a relatively high flowrate to clean the perforations in the well casing and to fracture the formation after which a slurry containing props (e.g. gravel) is injected at a lower flowrate to prop the formation and gravel-pack the wellbore around the screen.

2. Background Art

In completing a production or injection interval of a subterranean formation(s) within a cased wellbore, it is common to perforate the casing adjacent the interval and "hydraulically fracture" the formation by pumping a fluid (e.g. gel) down the wellbore and into the formation through the perforations in the casing. The cased wellbore adjacent the interval is then "gravel-packed" by lowering a well screen into the casing and filling the well annulus between the casing and the screen with "gravel" (e.g. sand). The gravel is sized to allow flow of fluids through the gravel and into the screen while blocking the flow of particulate materials.

A major problem exists in this type of completion, however, in that the casing perforations often become plugged with the debris and/or fluid-loss control materials which are normally present in a wellbore during a completion operation. Accordingly, when the "gravel-pack" (i.e. screen surrounded by sand) is subsequently installed within the wellbore, flow of formation fluids through these plugged perforation is blocked or severely restricted thereby seriously affecting the optimal perforation packing, and production of the well.

To alleviate this problem in gravel-pack completions, a wash tool is placed on the lower end of the workstring and lowered into the wellbore to wash out and remove any plugging material from the perforations. The workstring and wash tool is then removed and a second string with a gravel-pack screen on its lower end is placed in the wellbore. A slurry containing the "gravel" (e.g. sand") is pumped down the workstring and out through a "cross-over" into the annulus formed between the casing and the screen.

As sand is deposited from the slurry in the well annulus to form the gravel-pack in the casing around the screen, it also "packs" the perforations, themselves, with permeable sand. As will be recognized by those skilled in the art, adequate packing of the perforations is considered very important in any successful gravel-pack completion. Unfortunately, however, this two step procedure of first lowering and removing a wash tool on a workstring and then lowering the gravel-pack workstring and screen is both time consuming and expensive.

With the recent advent of "alternate flowpath technology", it is now possible to lower a single, gravel-pack workstring, having a screen on the lower end thereof, into the wellbore and then use this single workstring in both the fracturing of the formation and the placing of gravel within the formation, perforations, and the well annulus around the screen. In these types of completions, the gravel-pack screens carry "alternate flowpaths" (e.g. one or more shunt tubes) which substantially extend along the length of the screen. Each of the shunts have openings spaced along its length so that the fracturing fluid and/or gravel slurry can by-pass any sand-bridges which may form in the well annulus during the fracturing and/or gravel-placing operations. This allows good distribution of the fracturing fluid and/or slurry across the entire length of the completion interval without lowering additional workstrings. For examples and a good discussion of such screens, see U.S. Pat. Nos. 4,945,991; 5,082,052; and 5,113,935, which are incorporated herein by reference.

One method for fracturing a formation and then gravel-packing the wellbore using such an alternate-path, well screen is disclosed in U.S. Pat. No. 5,417,284 wherein the screen is first lowered into position in a wellbore on a workstring. A fracturing fluid (e.g. gel) and a gravel slurry are then pumped down the wellbore through separate paths and into the different ends of the well annulus around the screen. Since the fracturing fluid and the slurry are flowing countercurrent to each other within the well annulus, in some instances, it is believed that the gravel from the slurry may be deposited and accumulate adjacent certain plugged perforations in the casing before the fracturing gel (i.e. substantially no props) has had a chance to flow through and remove the plugging material from those perforations. If and when this occurs, no gravel can flow through the plugged perforations but instead, will merely further compact the plugging material in these perforations thereby preventing any substantial flow of formation fluids into the wellbore through these perforations when the well is put on production.

Another "alternate flowpath" method for fracturing and gravel-packing a well is disclosed in U.S. Pat. No. 5,435,391 wherein the screen is first lowered into a wellbore on a workstring and then slugs of fracturing fluid (e.g. gel) and a slurry are alternately pumped down the workstring and into the top of the well annulus. The alternating slugs of gel and slurry permit thick intervals of a production/injection zone to be fractured and gravel packed since the alternate flowpaths on the screen allow the fracturing fluid and/or slurry to by-pass any sand bridges which may form in the well annulus during the operation. Again, however, by alternating the gel and slurry, the sand from the slurry may deposit out into the well annulus adjacent certain plugged perforations before the gel has had a chance to flow through those perforations. Accordingly, these perforations may remain plugged after the operation is complete, thereby reducing the number of perforations available for flow of production/injection fluids into or out of the wellbore.

SUMMARY OF THE INVENTION

The present invention provides a method for gravel-packing a completion interval of a subterranean formation which is traversed by a cased wellbore wherein the perforations in the well casing are cleaned of any plugging materials before the gravel (e.g. sand) is placed within the wellbore. This is accomplished by lowering a screen having alternate flowpaths thereon into the perforated casing adjacent the completion interval and then pumping a clear fluid (e.g. clear fracturing gel which has substantially no particulate material therein) down the wellbore and out through the perforations into the formation.

The clear gel is pumped at a rate (e.g. greater than 8 barrels per minute) and pressure (greater than the fracturing pressure) sufficient to (a) force any plugging material (e.g. debris and/or fluid-loss control material) from the perforations and into the formation and (b) initiate and expand a fracture in the formation. Once the perforations are clear for flow and the fracture is expanded, the pumping of clear fracturing gel is ceased and a slurry containing proppants (e.g. particulate material such as sand) is pumped at a lower rate down the wellbore (e.g. less than 6 barrels per minute). This permits use of small-sized, alternate paths (shunts) with low or modest flow capacity. The slurry flows through the open and clear perforations into the formation where it deposits the proppants in the fracture. As the fracture fills with props, the slurry also deposits the sand from the slurry in both the perforations and within the completion interval annulus around the screen.

If and when a sand bridge(s) forms in the annulus around the screen, the alternate flowpaths on the screen (e.g. shunt tubes having spaced openings along their lengths) will allow the slurry to by-pass the blockage caused by the sand bridge. This permits the slurry to be delivered to all levels within the completion annulus so that sand from the slurry can be deposited across both the fracture and the completion annulus. Also, by cleaning any plugging material from all of the perforations prior to the placement of the sand, the perforations, themselves, can readily be packed with sand using small size shunts (i.e. 1 to 1½ inch or smaller) thereby providing good, permeable passages for flow of fluids out of and/or into the wellbore once the well is put on production. The capability of using small shunts allows use of larger screens, and permits higher ultimate production rates.

BRIEF DESCRIPTION OF THE DRAWINGS

The actual construction, operation, and the apparent advantages of the present invention will be better understood by referring to the drawings in which like numerals identify like parts and in which.

BEST KNOWN MODE FOR CARRYING OUT THE INVENTION

Figure 1:
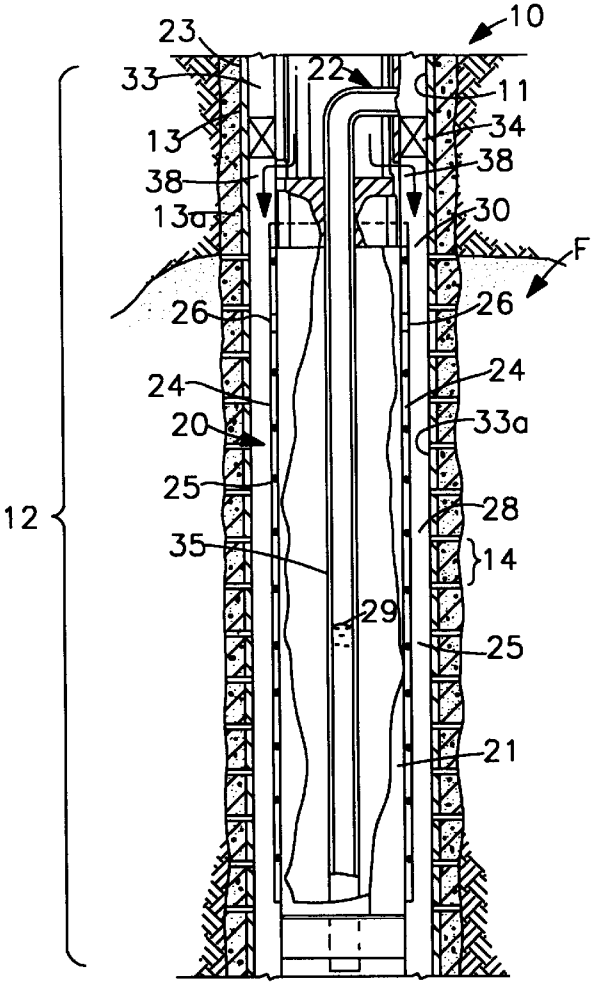
FIG. 1 is an elevational view, partly in section, of the lower portion of a typical, alternate flowpath screen in an operable position within a cased wellbore adjacent a completion interval as a clear fluid (e.g. fracturing gel with no props) is being flowed into said completion interval in accordance with one step of the present invention.

Referring more particularly to the drawings, FIG. 1 illustrates the lower end of a producing and/or injection well 10. Well 10 has a wellbore 11 which extends from the surface (not shown) through a completion interval 12. Wellbore 11 is typically cased with a casing 13 which, in turn, is secured in place by cement 13*a*. While the method of the present invention is illustrated primarily as being carried out in a vertical cased wellbore, it should be recognized that the present invention can equally be used in inclined and horizontal wellbores.

As illustrated, completion interval 12 is a formation(s) having a substantial length or thickness which extends vertically along wellbore 11. Casing 13 may have perforations 14 throughout completion interval 12 or may be perforated at selected levels within the fracture interval. Since the present invention is also applicable for use in horizontal and inclined wellbores, the terms "upper and lower", "top and bottom", as used herein are relative terms and are intended to apply to the respective positions within a particular wellbore while the term "levels" is meant to refer to respective positions lying along the wellbore between the terminals of the completion interval 12.

A workstring 20 is positioned in wellbore 11 and extends from the surface (not shown) to completion interval 12. As illustrated, workstring 20 includes a gravel pack screen 21 which is connected through a conventional "cross-over" 22 onto the lower end of tubing string 23 and which is positioned adjacent the completion interval when in its operable position. "Gravel pack screen" or "screen" as used herein, is intended to be generic and to include screens, slotted pipes, screened pipes, perforated liners, pre-packed screens and/or liners, combinations of same, etc. which are used in well completions of this general type. Screen 21 may be of a continuous length, as shown, or it may be comprised of a plurality of screen segments connected together by subs or "blanks". Workstring 20 is constructed substantially the same as that disclosed in U.S. Pat. No. 5,435,391, issued Jul. 25, 1995, and which is incorporated herein by reference.

One or more (e.g. four) small shunt tubes 24 (i.e. 1 to 1½ inch or smaller) are spaced radially around and extend longitudinally along screen 21 whereby they extend substantially throughout completion interval 12. Each of shunt tubes 24 has a plurality of openings 25 spaced along its respective length which provide "alternate flowpaths" for the delivery of fluids to different levels within the fracture interval 12 for a purpose to be discussed in detail below. Each shunt tube may be open at both of its ends to allow fluids to enter therein or the entry of fluid may be provided through some of the openings 25, themselves (e.g. those near the top and bottom of the tube). Shunts tubes of this type have been used to provide alternate flowpaths for fluids in a variety of different well operations, see U.S. Pat. Nos. 4,945,991; 5,082,052; 5,113,935; 5,161,613; and 5,161,618.

While openings 25 in each of the shunt tubes 24 may be a radial opening extending from the front of the tube, preferably the openings are formed so that they exit through each side of the shunt tube 24, as shown. Further, it is preferred that an exit tube 26 (only two shown in FIG. 1) is provided for each opening 25. The construction and purpose for exit tubes 26 is fully disclosed and claimed in U.S. Pat. No. 5,419,394, issued May 30, 1995, which is incorporated herein by reference.

In operation, if wellbore 11 extends for a distance substantially below the bottom of completion interval 12, the wellbore is blocked-off adjacent the lower end of fracture interval 12 by a plug or packer (not shown), as will be understood in the art. Workstring 20 is lowered into wellbore 11 which, in turn, forms a well annulus 33 between workstring 20 and the wellbore 11. The gravel pack screen 21 is positioned adjacent completion interval 12 and packer 34, which is carried on the workstring, is set to isolate that portion 33*a* of the annulus which lies adjacent completion interval 12. As will be understood by those skilled in the art, wellbore 11 and workstring 20 will normally be filled with the completion fluid that is normally present in wellbore 11 as workstring 20 is lowered therein.

With workstring 20 in place, a "clear fracturing fluid" is pumped down workstring 30 down through tubing 22, out ports 38 of cross-over 21, and into the top of annulus 33*a*. The term "clear fracturing fluid" refers to a fracturing fluid which does not contain any substantial amount of particulate materials (e.g. sand). The fracturing fluid 30 can be any well-known fluid commonly used for fracturing formations (e.g. water, etc.) but preferably is one of the many commercially-available substantially, particle-free "gels" which are routinely used in conventional fracturing operations (e.g. Versagel, product of Halliburton Company, Duncan, Okla.).

As the fracturing fluid 30 flows into annulus 33*a*, annulus 33 is shut off at the surface which effectively blocks any further upward flow of completion fluid 28 through washpipe (see interface 29 in FIG. 1) and annulus 33. The clear fracturing fluid is pumped at a relatively high flowrate (e.g. at least about 8 barrels per minute) As the annulus pressure increases, the fracturing fluid 30 is forced through the perforations 14 and into the formation to initiate and expand fracture F in the completion interval 12. Also, as the clear fracturing fluid is forced through the perforations, any debris and/or fluid-loss control material which might be plugging the perforations is forced out of the perforations and into the formation along with the clear fracturing fluid, thereby leaving the perforations clean and open to flow.

Figure 2:
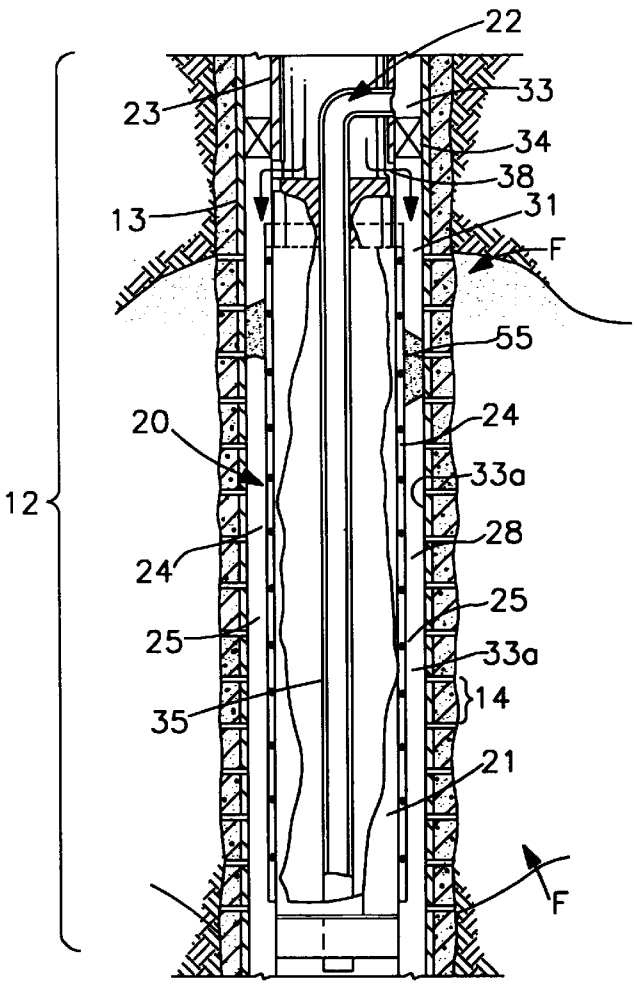
FIG. 2 is an elevational view, partly in section, similar to that of FIG. 1, wherein gravel slurry is being flowed into said completion interval in accordance with another step of the present invention.

Now referring to FIG. 2, once the fracture F has been formed and the perforations 14 have been cleaned of plugging material, the flow of clear fracturing fluid 30 is replaced with the flow of a slurry 31 which is laden with proppants (e.g. gravel and/or sand). The flowrate of the slurry (e.g. less than about 6 barrels) is preferably substantially less than that of the clear fracturing fluid. The slurry flows into the top of annulus 33*a*, through the clean perforations 14 and into fracture A where it deposits the proppants.

As fracture F becomes filled with proppants, it is not unusual for a sand bridge(s) 55 (FIG. 2) to form somewhere in annulus 33*a*. Normally, such bridges will block any further flow of slurry in the annulus 33*a* so that gravel can no longer be delivered to annulus 33*a* below the sand bridge thereby resulting in poor distribution of gravel across the completion interval. However, in the present invention, even after a sand bridge 55 is formed in annulus 33*a*, slurry can still flow through the "alternate flowpaths" provided by shunt tubes 24 and out the openings 25 which lie below bridge 55 thereby providing a good gravel-pack across the entire completion interval 12.

Since the clear fracturing fluid contains substantially no particulate material, such as sand, no sand bridges will be formed during the fracturing and perforation-cleaning operation. Accordingly, it is possible to pump the fracturing fluid at a relative higher rate (e.g. more than about 8 barrels per minute) thereby providing both the better cleaning of the perforations and the initiating and expanding of the fracture in the formation. However, since all of the slurry must be carried by the relatively small shunt tubes 24 when a sand bridge forms in the annulus 33*a*, it is beneficial, if not crucial, to substantially reduce the flowrate at which the slurry is pumped into the wellbore (e.g. no more than 6 barrels per minute) so as not to rupture or otherwise damage the shunt tubes during the placement of the gravel.

The pumping of the slurry is continued until a final high pressure sand off is obtained which indicates that substantially the fracture F has been propped and that perforations 14 and the annulus 33*a* around screen 21 has been filled with proppants thereby forming a highly effective, gravel-pack completion across the fracture interval.

What is claimed is:

1. A method for gravel-packing a completion interval of a subterranean formation which is traversed by a cased wellbore, said method comprising:

forming perforations in said cased wellbore adjacent said completion interval;

positioning a workstring in the wellbore to form a well annulus between said workstring and said wellbore, said workstring including a gravel pack screen which lies adjacent said completion interval to form a completion interval annulus when said workstring is in place within said wellbore, said workstring also including alternate flowpath formed by shunt tubes which are spaced radially around said gravel-pack screen and which extend through said completion interval, each of said shunt tubes having inlet and outlet openings spaced along its length;

pumping a clear fluid having substantially no particulate material therein into one end of said completion interval annulus and out through said perforations into said formation to thereby force any plugging material from said perforations to clear same for flow;

continuing pumping of said clear fluid into said one end of said interval annulus and through said perforations until all of said perforations are clear for flow;

ceasing pumping of said clear fluid;

pumping a slurry containing proppants into said one end of said completion interval annulus to deliver said proppants through said alternate flowpaths to levels within said fracture interval to thereby deposit proppants in said perforations and in said completion interval annulus;

continuing pumping of said slurry until said perforations and said completion interval annulus are filled with said proppants.

2. The method of claim 1 wherein said clear fluid is a clear fracturing gel and said proppants in said slurry are sand.

3. The method of claim 1 wherein said clear fluid is pumped at a higher flowrate than is said slurry.

4. The method of claim 1 wherein said clear fracturing fluid is pumped at a rate of greater than about 8 barrels per minute and said slurry is flowed at a rate of less than about 6 barrels per minute.

5. The method of claim 2 including:

pumping said clear fracturing gel through said perforation into said formation to initiate and expand a fracture therein.

6. The method of claim 5 including:

isolating said portion of said annulus which lies adjacent said completion interval prior to pumping said clear fracturing fluid into said completion interval annulus.

7. The method of claim 6 wherein said clear fracturing gel is pumped at a higher flowrate than is said slurry.

8. The method of claim 7 wherein said clear fracturing gel is pumped at a rate of greater than about 8 barrels per minute and said slurry is pumped at a rate of less than about 6 barrels per minute.

* * * * *